United States Patent [19]

Capp et al.

[11] Patent Number: 4,718,854

[45] Date of Patent: Jan. 12, 1988

[54] LOW PROFILE PRESS FIT CONNECTOR

[75] Inventors: Randolph E. Capp, Mechanicsburg; Douglas M. Johnescu, York; Ronald C. Laudig, Mechanicsburg; George W. Michael, III, Harrisburg; Charles D. Pearl, Grantville, all of Pa.

[73] Assignee: AMP Incorporated, Harrisburg, Pa.

[21] Appl. No.: 943,534

[22] Filed: Dec. 18, 1986

[51] Int. Cl.[4] ..... H01R 9/09

[52] U.S. Cl. ..... 439/63; 439/82; 439/581; 439/108

[58] Field of Search ..... 339/17 R, 17 C, 17 LC, 339/14 R, 14 P, 217 R, 217 S, 220, 221, 177 R, 177 E, 252 P, 75 P, 75 R, 75 M, 91 R, 136, 256–258

[56] References Cited

U.S. PATENT DOCUMENTS

| | | | |
|---|---|---|---|
| 2,814,024 | 11/1957 | Narozny | 339/220 R |
| 3,072,880 | 1/1963 | Olsson | 339/221 R |
| 3,193,792 | 7/1965 | Shea, Jr. | 339/176 |
| 3,296,363 | 1/1967 | Laudig et al. | 147/89 |
| 3,384,703 | 5/1968 | Forney, Jr. et al. | 174/75 |
| 3,418,623 | 12/1968 | Ruehlemann | 339/94 |
| 3,774,142 | 11/1973 | Siegler | 339/14 R |
| 3,846,741 | 11/1974 | Kunkle et al. | 339/221 R |
| 3,941,449 | 3/1976 | Baumanis | 339/217 S |
| 4,125,308 | 11/1978 | Schilling | 339/17 LC |
| 4,191,440 | 3/1980 | Schramm | 339/17 |
| 4,453,796 | 6/1984 | Monroe | 339/177 R |
| 4,513,499 | 4/1985 | Roldan | 29/874 |
| 4,519,667 | 5/1985 | Canning et al. | 339/186 M |
| 4,548,453 | 10/1985 | Mummey et al. | 339/17 C |
| 4,598,961 | 7/1986 | Cohen | 339/177 R |

FOREIGN PATENT DOCUMENTS

| | | | |
|---|---|---|---|
| 8101631 | 6/1981 | Sweden | 339/177 R |

OTHER PUBLICATIONS

AMP Incorporated Catalog 83–719, Issued Aug. 1984, pp. 3, 4, 19, 20 and 13.

*Primary Examiner*—Gil Weidenfeld
*Assistant Examiner*—David Pirlot

[57] ABSTRACT

A coaxial connector 10 includes a conector body (21) and a plurality of grounding pin contacts (25, 25) extending from the connector body (21) to be extended into and through a plurality of apertures (32, 32) in a printed circuit board (12) to electrically and mechanically connect the connector (10) to the board (12). The grounding pin contacts (25, 25) have a length greater than the thickness of the board (12) and include first compliant pin contact portions adapted to be positioned within the apertures (32, 32) to frictionally engage the sidewalls of the apertures (32, 32) to frictionally retain the connector (10) to the board (12) and to electrically connect the connector (10) to the board (12), and second compliant pin contact portions (51, 51) which extend out of the apertures (32, 32) beyond the opposite side of the board (12) and which, upon, passing through the apertures (32, 32) expand to a diameter greater than that of the apertures (32, 32) to mechanically lock the connector to the board. The grounding pin contacts (25, 25) are formed integral with grounding pin contact means which is mounted to the outer shell (21) of the connector (10) after the compliant portions (51, 51) of the grounding pin contacts (25, 25) are formed to simplify manufacturing procedures and permit use of different materials for the grounding pin contacts (25, 25) and the outer shell (21).

15 Claims, 5 Drawing Figures

FIG. 3
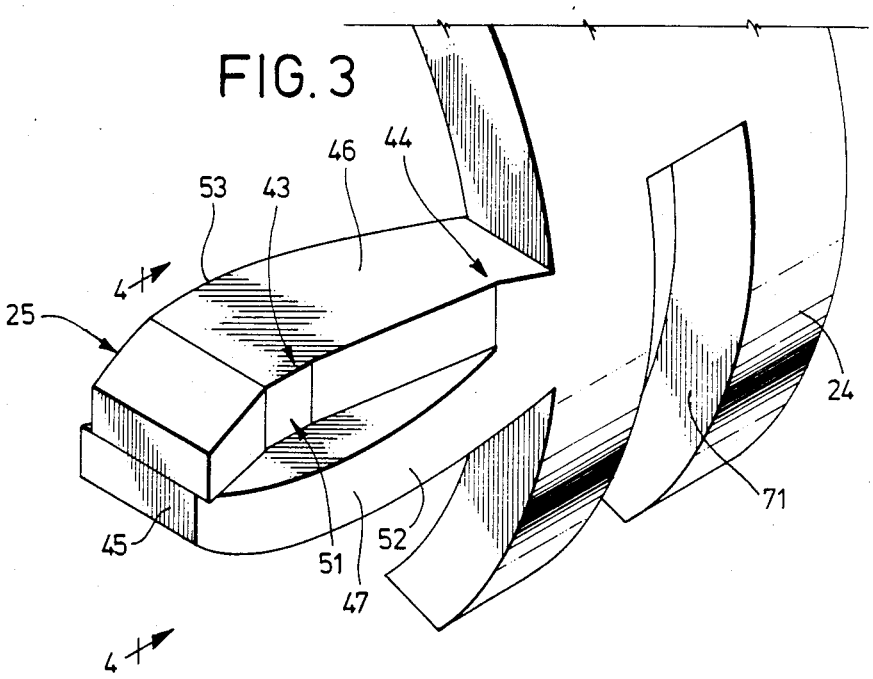
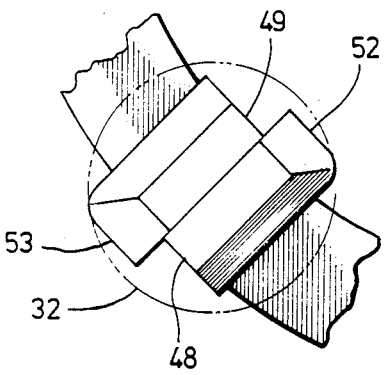
FIG. 4
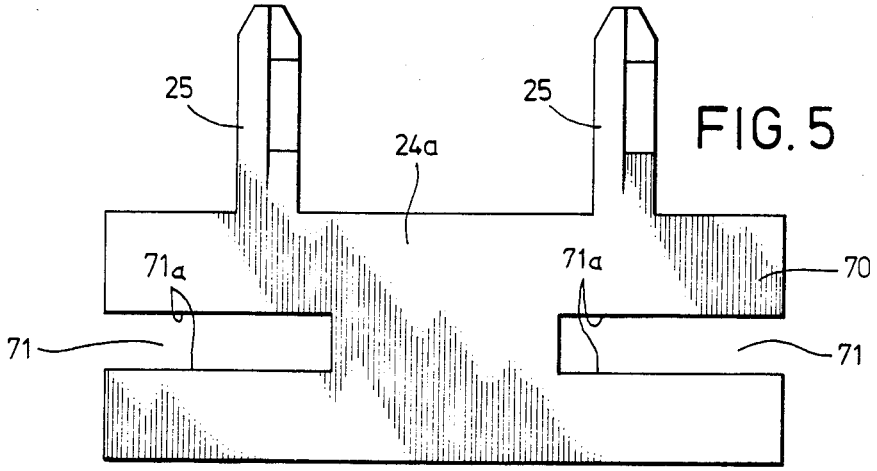
FIG. 5

LOW PROFILE PRESS FIT CONNECTOR

BACKGROUND OF THE INVENTION

The present invention relates generally to electrical connectors and, in particular, to coaxial electrical connectors for printed circuit boards.

Electrical connectors are frequently used to provide electrical connection to printed circuit boards. Typically, the connector is both physically mounted to the printed circuit board and electrically connected to conductive paths on the board, and is matable with a complementary connector coupled to external circuitry or the like to complete electrical connection to the board.

In prior systems, the connector was mounted to the printed circuit board by extending one or more pin contacts on the connector through apertures in the board, and then connecting the pin contacts to the board with an electrically conductive solder such that the solder both mechanically retained the connector on the board and electrically connected the pin contacts to conductive paths on the board. Sometimes also, the connector was additionally secured to the board with separate fastening structure such as bolts or the like extended through aligned apertures in the connector and the board.

There were several disadvantages to using solder to mount a connector to a printed circuit board. Initially, the necessity of applying the solder to selected areas of the printed circuit board increased manufacturing costs. Also, when applying the solder, solder bridges were sometimes formed that caused short circuits across conductive paths on the board or between contact pins on the connector.

The use of bolts or other separate fastening structure was also not desirable as such structure was easily lost during shipping or handling, and utilized valuable space on the printed circuit board which could generally be put to better use.

Because of the inadequacies of using solder to mount connectors to a printed circuit board, more recent connector designs contained contact pins having enlarged compliant portions which were press fit into the apertures in the board to retain the connectors by frictional engagement between the contact pins and the sidewalls of the apertures. The walls of the apertures were plated with a conductive coating connected to conductive paths on the board to electrically connect the contact pins to the board. An example of a connector incorporating compliant contact pins for retention and electrical connection of the connector to a printed circuit board is disclosed in U.S. Pat. No. 4,191,440. The connector of this patent is satisfactory in many applications; however, there are numerous applications wherein a greater degree of retention is desired to ensure that the connector remains firmly secured to the printed circuit board at all times.

SUMMARY OF THE INVENTION

The present invention comprises an electrical connector for printed circuit boards which includes a connector body and at least one pin contact extending from the connector body to be extended into and through a plated aperture in the printed circuit board to electrically and mechanically connect the connector to the board. The at least one pin contact has a length greater than the thickness of the board and is compliant over a substantial portion of its length such that when the connector is mounted to one side of the board, the pin contact includes a first compliant portion positioned within the aperture and a second compliant portion extending out of the aperture beyond the opposite side of the board. The first and second compliant pin contact portions each have an uncompressed diameter which is greater than that of the aperture through which they extend, but which are compressible to permit insertion of the pin contact into and through the aperture.

When the connector is mounted to the board, the first compliant pin contact portion frictionally engages the sidewall of the aperture to frictionally retain the connector on the printed board and to electrically connect the connector to the board. The second compliant pin contact portion extends beyond the opposite side of the board and, upon clearing the aperture during mounting of the connector, expands somewhat to a diameter greater than that of the aperture to mechanically lock the connector to the board. According to the present invention, therefore, the connector is both frictionally retained and mechanically locked to the printed circuit board to more reliably retain the connector on the board.

According to a presently preferred embodiment, the connector comprises a coaxial connector; and the at least one pin contact comprises a plurality of grounding pin contacts for grounding the outer shielding conductor of a coaxial cable to the printed circuit board. According to a further aspect of the invention, the plurality of grounding pin contacts is integral with grounding pin contact means which is mounted to the outer shell of the connector body after the grounding pin contacts have been stamped and formed. By providing the grounding pin contacts on separate means mountable to the connector body, rather than forming the pin contacts integral with the connector body as in known connectors, lower cost and greater manufacturing efficiency are achieved. In particular, because of its relatively low cost, the outer shell of connectors is typically manufactured from zinc, a material having poor spring properties. Therefore, to manufacture a connector having integral compliant grounding pin contacts, it was necessary to utilize a more expensive material having the requisite spring properties for the entire outer shell of the connector.

In the present invention, the inexpensive zinc shell is retained; and the grounding pin contact means is formed of a copper-iron alloy having satisfactory resilient properties to form the compliant portions on the grounding pin contacts. Also, because the grounding pin contact means is separate from the connector shell, the grounding pin contact means can be stamped and formed from flat sheets and the compliant pins formed thereon while the stamping is still in a flat configuration prior to being mounted to the connector body. In prior connectors, it was necessary to form the compliant pin contact portions as they extended from the cylindrical connector body resulting in a more difficult manufacturing procedure.

Further advantages and important features of the invention will become apparent hereinafter in conjunction with the following detailed description of a presently preferred embodiment.

BRIEF DESCRIPTION OF THE DRAWINGS

FIG. 3 is an enlarged perspective view of a grounding pin contact of FIGS. 1 and 2;

FIG. 4 is an end view of the grounding pin contact of FIG. 3 looking in the direction of arrows 4—4 in FIG. 3; and FIG. 5 illustrates a stamping from which a grounding pin contact member of FIGS. 1 and 2 is made.

DETAILED DESCRIPTION OF THE PREFERRED EMBODIMENT

Figure 1:
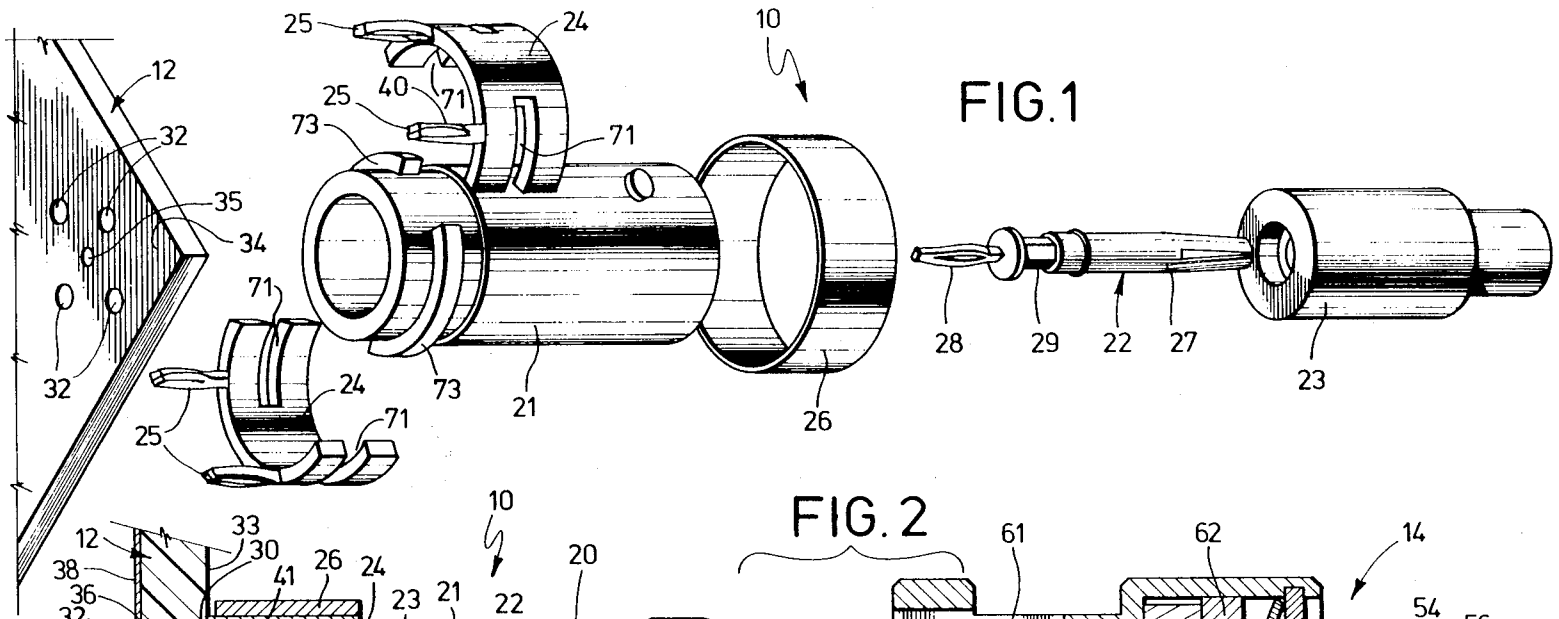
FIG. 1 is an exploded perspective view of a coaxial connector for printed circuit boards according to a presently preferred embodiment of the invention.
Figure 2:
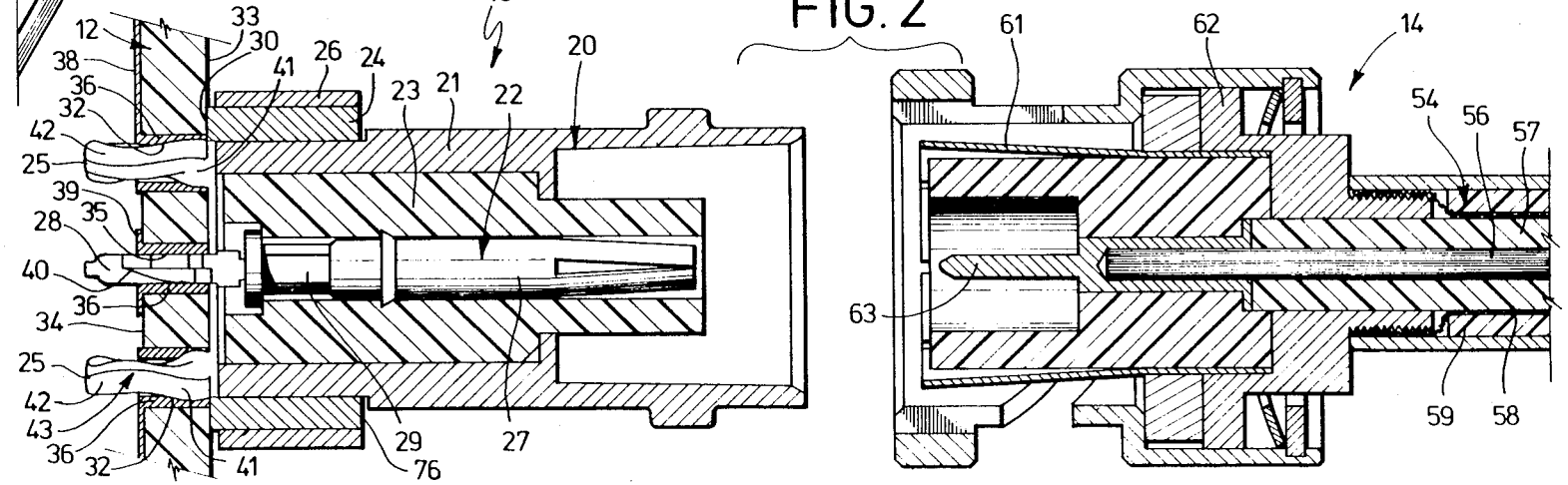
FIG. 2 is a cross-sectional view illustrating the connector of FIG. 1 assembled and mounted to a printed circuit board, and further illustrating a mating connector therefor.

FIGS. 1 and 2 illustrate exploded perspective and assembled, cross-sectional views, respectively, of an electrical connector according to a presently preferred embodiment of the invention. The connector is generally designated by reference numeral 10 and comprises a coaxial electrical connector for use with printed circuit boards. More particularly, connector 10 is adapted to be mounted to a printed circuit board schematically illustrated at 12, and to be mated with a complementary connector 14 (FIG. 2) connected to external circuitry or the like (not shown), to complete electrical connection between the external circuitry and conductive paths on the printed circuit board.

Connector 10 includes tubular-shaped outer shell 21 formed of a suitable, electrically conductive material such as zinc; a center contact assembly 22; and a dielectric plug body 23 of polytetrafluoroethylene (Teflon) or the like for supporting the center contact assembly 22 axially within the outer shell and for electrically insulating the center contact assembly from the outer shell. An annular internal flange 21*a* of the shell 21 overlaps the dielectric plug 23. In addition, and as will be described more fully hereinafter, connector 10 includes grounding pin contact means 24 having a plurality of grounding pin contacts 25 thereon, and a retention ring 26 for securing the grounding pin contact means 24 to the outer shell 21.

In the illustrated embodiment, center contact assembly 22 includes a center contact 27 of the socket type, and a center pin contact 28 attached thereto as by crimping as shown at 29. As best shown in FIG. 2, grounding pin contacts 25 and center pin contact 28 extend outwardly from the base 30 of the connector body which is generally designated by reference numeral 20.

Connector 10 is matable with complementary coaxial connector 14 to complete electrical circuits through the connectors. Complementary connector 14 terminates a coaxial cable 54 having a center conductor 56 surrounded by a dielectric sheath 57. An outer braided conductor 58 surrounds sheath 57 and is, in turn, covered by an outer jacket 59. As known to those skilled in the art, braided outer conductor 58 functions to shield the center conductor 56 and the signals carried thereby from electromagnetic interference, and is electrically coupled to an outer contact 61 of the connector 14. Center conductor 56 of the cable 54 is electrically coupled to center pin contact 63 of connector 14.

When connector 14 is mated with connector 10, center pin contact 63 mates with socket contact 27 of connector 10 to connect the center conductor 56 of the coaxial cable through the connectors to center pin contact 28 of connector 10. Similarly, outer contact 61 of connector 14 engages the conductive outer shell 21 of connector 10 to complete electrical connection of the braided outer conductor 58 of cable 54 to the shell 21, and to the grounding pin contact means 24 and the grounding pin contacts 25 thereon. Complementary connector 14 does not form a part of the present invention and, therefore, is not described in detail herein. Complementary connector 14 may, however, be similar in construction to complementary connector 20′ disclosed in U.S. Pat. No. 3,296,363.

Connector 10 is adapted to be mounted to a printed circuit board 12 by extending grounding pin contacts 25 and center pin contact 28 into and through apertures in the printed circuit board. More particularly, printed circuit board 12 includes a plurality of four apertures 32 arranged in a generally circular pattern, and a single aperture 35 which is positioned substantially centrally within the circular pattern of apertures 32. Apertures 32 and 35 extend completely through the board from mounting side 33 to opposite side 34 thereof. The sidewalls of apertures 32 and 35 are plated with an electrically conductive coating 36, as shown in FIG. 2, which coatings are electrically connected to conductive paths 38 and 39 on the board. Coating 36 may comprise a thin layer of copper having a tin-lead coating plated thereon.

When connector 10 is mounted to printed circuit board 12, the grounding pin contacts 25 extend through apertures 32 in the board; and the center pin contact 28 extends through aperture 35. As will be explained more fully hereinafter, the pin contacts will engage the conductive coatings 36 on the aperture sidewalls to complete electrical connection from the connector (and hence from cable 54) to the conductive paths 38 and 39 on the printed circuit board.

Center pin contact 28 can be of any suitable construction, but preferably includes a compliant portion illustrated schematically at 40 which is adapted to be press-fit into aperture 35 to retain the pin contact 28 within aperture 35 by frictional engagement with the sidewall of the aperture, and to simultaneously electrically connect the center pin contact to conductive paths 39 on the board via the conductive coating 36 of the aperture. As indicated previously, one known type of compliant pin contact is disclosed in U.S. Pat. No. 4,191,440.

Grounding pin contacts 25 are similarly adapted to be press-fit into apertures 32 of the printed circuit board 12 to also be retained within the apertures by frictional engagement with the sidewalls of the apertures, and to electrically connect the grounding pin contacts to conductive paths 38 on the board to dissipate noise on the outer conductive sheath 58 of cable 54 to external ground as is known to those skilled in the art. In addition, however, and for greater retention assurance, grounding pin contacts 25 are constructed to also mechanically lock the connector 10 to the board 12.

In particular, as shown in FIG. 2, grounding pin contacts 25 have a length which is greater than the thickness of printed circuit board 12 such that when connector 10 is mounted to mounting side 33 of board 12, a first portion 41 of the grounding pin contacts will be positioned within apertures 32; and a second portion 42 will extend outwardly of the aperture beyond opposite side 34 of the board. In addition, the grounding pin contacts 25 are compliant over a substantial portion of their length from adjacent base ends 44 of the pin contacts to adjacent the tip ends 45 thereof (see FIG. 3). The compliant portion of the grounding pin contacts is generally designated by reference numeral 43.

As best shown in FIGS. 3 and 4, the compliant portions 43 of grounding pin contacts 25 are formed by partially shearing the pins transversely along a substantial portion of their length to define partially sheared grounding pin contact halves or sections 46 and 47. The partial shearing can be achieved in any suitable manner using appropriate shearing equipment to apply a shearing force to surfaces 48 and 49 of the grounding pin contacts as indicated in FIG. 4.

Shearing of the grounding pin contacts is effected such that the grounding pin contacts are sheared to a maximum extent on the second grounding pin contact portions at approximately the location indicated by arrow 51 in FIG. 3 with the amount of shear decreasing gradually toward base ends 44 and tip ends 45 of the contacts. In fact, although a slight amount of shear is illustrated at the widened tip end 45 in FIGS. 3 and 4, it is preferable tha the extent of widening at the tip end 45 be minimized to facilitate insertion of the pins into the apertures 32 in the printed circuit board. The shearing is effected to produce outer surfaces 52 and 53 on pin contact halves 46 and 47 which are tapered outwardly from the base ends 44 at an angle of about 5° from the axis of the pins to vicinity 51 of maximum diameter, and then tapered inwardly toward the tip ends 45 of the pin contacts.

As best shown in FIG. 4, the shearing produces a compliant pin contact portion 43 which has a maximum diameter which is greater than that of the aperture 32 (shown in dotted line in FIG. 4), but which is compressible to permit the pin contact to be inserted into and through the aperture.

In a typical embodiment of the invention wherein the apertures 32 in printed circuit board 12 have a diameter of about 0.064 inch, grounding pin contacts 25 have a maximum diameter at location 51 of about 0.083 inch. Upon being inserted into the apertures 32, however, the compliant portions 43 are compressed inwardly by the sidewalls of the apertures to permit the pin contacts to be extended into and through the apertures. The first pin contact portions 41 are positioned within apertures 32 in press-fit relationship with the sidewalls thereof and exert a substantial force against the sidewalls to frictionally retain the pins within the apertures by frictional engagement with the sidewalls.

After passing through the apertures 32 in the board, the second pin contact portions 42 extend beyond the opposite face 34 of the board; and upon clearing the board, the compliant portions expand somewhat. At the location 51 of largest diameter, for example, which is preferably positioned on the grounding pin contacts to just clear the apertures, the grounding pin contacts expand to a diameter of approximately 0.068 inch, which is slightly greater than that of the apertures. The compliant second pin contact portions of the grounding pin contacts thus function as locking means for mechanically locking the connector to the board.

With the present invention, therefore, the grounding pin contacts 25 oppose withdrawal of the connector 10 from the printed circuit board 12, both frictionally by engagement of the compliant first pin contact portions with the sidewalls of the apertures and mechanically by expansion of the compliant second pin contact portions to lock the connector to the board. Greater retention of the connector to the printed circuit board is thus achieved without using solder or separate retention structure.

In accordance with a further important aspect of the invention, the grounding pin contacts 25 are formed on a pair of grounding pin contact members 24 which are formed separate from the outer shell 21 of the connector 10, and are attached to the outer shell after the grounding pin contacts have been fully formed and shaped thereon. The grounding pin contact members are each stamped and formed from a flat sheet to provide a relatively thin and flat stamping **24*a* as illustrated in FIG. 5. Stamping 24*a* is formed of a copper-iron alloy or another electrically conductive material having spring-like properties suitable for forming the compliant portions 43 on the grounding pin contacts 25. Stamping 24*a*** is cut and shaped, and the compliant portions on the grounding pin contacts formed thereon using conventional stamping and forming equipment as is well known to those skilled in the art.

As shown in FIG. 5, stamping **24*a* comprises a relatively thin and flat, elongated strip or plate 70 having a plurality of integral grounding pin contacts 25 extending from one edge thereof. A pair of elongated slots 71 is formed in the plate 70 as shown. Slots 71 are sized and positioned to receive elongated ribs 73 formed on the outer surface of outer shell 21 as shown in FIG. 1. Slots 71 and ribs 73** function as alignment means to automatically position the grounding pin contact members on the outer shell.

After the stampings **24*a* have been formed, they are curved for mounting to the outer shell 21, and are attached to the outer shell by fitting the ribs along the slots 71. After the grounding pin contact members 24 are mounted to the outer shell, a crimp ring 26** is positioned around the members and crimped to secure the members to the outer shell.

In the embodiment illustrated, two grounding pin contact members 24 are provided, each having two grounding pin contacts thereon and each extending around approximately one-half the circumference of the outer shell 21. If desired, a single grounding pin contact member completely surrounding the outer shell can be provided.

By providing the grounding pin contacts on one or more separate members which are secured to the outer shell of the connector, rather than formed integral with the outer shell as in known connectors, several advantages are achieved. Shearing of the grounding pin contacts to provide the compliant portions thereon can be accomplished more easily with less complex conventional equipment when the pin contacts extend from a flat stamping **24*a* rather than a curved cylindrical shell. The stamping 24*a* is thin and increases the size of the connector 10 only a small amount, thereby achieving a connector 10 that covers a relatively small space on the board 12**. Furthermore, the stamping can be made of a suitable, flexible, conductive metal such as copper-iron alloy; and the shell can be made of less expensive zinc. Zinc has relatively poor spring properties and is not suitable for the formation of the compliant portions on the pin contacts; and if the pin contacts are formed integral with the outer shell, it is necessary to form the entire outer shell of the more expensive copper-iron alloy to achieve the necessary compliant properties.

It should also be noted that the plane of thickness of each of the grounding pin contact members 24 has an upper edge 76 surrounding the connector body 20. Edge 76 conveniently functions as a bearing surface engageable by a suitable tool to push the plurality of pin contacts 25 and 28 into and through the apertures 32 and 35. Alternatively, flange 21*a* may be engaged by a suitable tool entering the shell 21 to push the pin contacts 25, 28. The ribs 73, 73 provide bearing surfaces against corresponding edges 71*a*, 71*a* of the plane of thickness of each of the corresponding members 24, 24 to effect insertion of the pin contacts 25, 28 and to resist separation of the members 24, 24 from the shell. The plane of thickness of each corresponding stamping 24*a* extends along the longitudinal axis of each corresponding contact 25, 25 and along the common direction of insertion of the contacts 25, 25, 28, and resists buckling of the stamping 24*a* during insertion of the contacts 25, 25, 28 or when the stamping 24*a* resists separation from the shell 21, for example, during coupling or uncoupling of the connectors 10 and 14.

While what has been described constitutes a presently preferred embodiment of the invention, it should be understood that the invention could take numerous other forms. For example, although pin contacts 25 comprise grounding pin contacts for grounding the outer braided conductor of a coaxial cable, the invention can be incorporated into signal-carrying and power-carrying pin contacts as well. Because the invention can take other forms, it should be recognized that the invention should be limited only insofar as is required by the scope of the following claims.

I claim:

1. In an electrical connector for mounting on a printed circuit board and for connection to conductive coatings of the printed circuit board in apertures extending through the printed circuit board, the connector comprising, a conductive shell encircling an insulative body, a conductive contact having a portion surrounded by the insulative body, and having a portion projecting outwardly from the shell, and conductive further electrical contacts integral with a conductive corresponding strip and projecting from an edge of the corresponding strip parallel to a thickness of the corresponding strip for insertion into corresponding apertures, the improvement comprising;

the further electrical contacts extend from an edge of the corresponding strip perpendicular to a length of the corresponding strip, the length of the corresponding strip is transverse to the axis of the shell, a conductive ring overlaps the length of the corresponding strip, and the length of the corresponding strip is overlapped by and between the shell and the ring.

2. In an electrical connector as recited in claim 1, the improvement further comprising;

an edge of the corresponding strip extends lengthwise of the corresponding strip along the thickness of the strip, and extends transverse to the lengths of the further electrical contacts, and provides a tool bearing surface projecting outwardly from the shell.

3. In an electrical connector as recited in claim 1, the improvement further comprising;

the corresponding strip and further contacts are fabricated from a material with spring properties, and the shell is fabricated from a material with lesser spring properties than that of the corresponding strip.

4. In an electrical connector as recited in claim 3, the improvement further comprising;

the shell is concentrically encircled by the corresponding strip and the ring.

5. In an electrical connector as recited in claim 3, the improvement further comprising;

each said further electrical contact having a free end and a portion of its length divided by a shear into a pair of separate contact sections elongated lengthwise of said contact and having separate tip ends at the free end, and each said contact section being bowed in a direction transverse to a corresponding other of said contact sections.

6. In an electrical connector as recited in claim 3, the improvement further comprising;

an edge of the corresponding strip extends lengthwise of the corresponding strip along the thickness of the strip, and extends transverse to the lengths of the further electrical contacts, and provides a tool bearing surface projecting outwardly from the shell.

7. In an electrical connector as recited in claim 3, the improvement further comprising;

alignment means for positioning the corresponding strip on the shell including rib means projecting from the shell and slot means in the corresponding strip for locked engagement with the rib means, and the rib means overlaps the thickness of the corresponding strip and provides a bearing surface against the thickness of the corresponding strip.

8. In an electrical connector as recited in claim 7, the improvement further comprising;

the shell is concentrically encircled by the corresponding strip and the ring.

9. In an electrical connector as recited in claim 7, the improvement further comprising;

each said further electrical contact having a free end and a portion of its length divided by a shear into a pair of separate contact sections elongated lengthwise of said contact and having separate tip ends at the free end, and each said contact section being bowed in a direction transverse to a corresponding other of said contact sections.

10. In an electrical connector as recited in claim 7, the improvement further comprising;

an edge of the corresponding strip extends lengthwise of the corresponding strip along the thickness of the strip, and extends tranverse to the lengths of the further electrical contacts, and provides a tool bearing surface projecting outwardly from the shell.

11. In an electrical connector as recited in claim 1, the improvement further comprising;

the external surface of the shell is concentrically encircled by the corresponding strip and the ring.

12. In an electrical connector as recited in claim 11, the improvement further comprising;

each said further electrical contact having a free end and a portion of its length divided by a shear into a pair of separate contact sections elongated lengthwise of said contact and having separate tip ends at the free end, and each said contact section being bowed in a direction transverse to a corresponding other of said contact sections.

13. In an electrical connector as recited in claim 11, the improvement further comprising;

an edge of the corresponding strip extends lengthwise of the corresponding strip along the thickness of the strip, and extends tranverse to the lengths of the further electrical contacts, and provides a tool bearing surface projecting outwardly from the shell.

14. In an electrical connector as recited in claim 1, the improvement further comprising;

each said further electrical contact having a free end and a portion of its length divided by a shear into a pair of separate contact sections elongated lengthwise of said contact and having separate tip ends at the free end, and each said contact section being bowed in a direction transverse to a corresponding other of said contact sections.

15. In an electrical connector as recited in claim 14, the improvement further comprising;

an edge of the corresponding strip extends lengthwise of the corresponding strip along the thickness of the strip, and extends tranverse to the lengths of the further electrical contacts, and provides a tool bearing surface projecting outwardly from the shell.

* * * * *